72-252 S9
10/15/85 OR 4,546,633

United States Patent [19]

Brauer et al.

[11] Patent Number: 4,546,633

[45] Date of Patent: Oct. 15, 1985

[54] APPARATUS FOR CONVEYING TUBULAR OR BAR-SHAPED ROLLED STOCK

[75] Inventors: Hans Brauer, Leichlingen; Kurt Leeuwestein, Duisburg-Neudorf, both of Fed. Rep. of Germany

[73] Assignee: Kocks Technik GmbH & Co., Hilden, Fed. Rep. of Germany

[21] Appl. No.: 655,364

[22] Filed: Sep. 27, 1984

Related U.S. Application Data

[63] Continuation of Ser. No. 359,698, Mar. 19, 1982, abandoned, which is a continuation of Ser. No. 269,712, Jun. 2, 1981, which is a continuation of Ser. No. 58,169, Jul. 17, 1979.

[30] Foreign Application Priority Data

Jul. 31, 1978 [DE] Fed. Rep. of Germany ..... 2833631

[51] Int. Cl.[4] ..... B21B 39/20; B21B 39/04; B21D 43/00; B65G 47/26

[52] U.S. Cl. ..... 72/252; 72/419; 72/426; 198/431; 198/433

[58] Field of Search ..... 72/201, 250, 252, 419, 72/426, 257; 198/418, 429, 431, 433, 425, 462, 474, 614, 774–776

[56] References Cited

U.S. PATENT DOCUMENTS

| | | | |
|---|---|---|---|
| 1,718,870 | 6/1929 | Noell | 72/251 |
| 3,340,850 | 9/1967 | Elliott | 198/418 |
| 3,718,062 | 2/1973 | Gilvar | 198/775 |
| 3,737,021 | 6/1973 | Reth | 198/418 |
| 3,739,619 | 6/1973 | Follrath et al. | 72/426 |
| 4,157,137 | 6/1979 | Hardouin | 198/425 |

FOREIGN PATENT DOCUMENTS

| | | | |
|---|---|---|---|
| 328579 | 10/1920 | Fed. Rep. of Germany | 198/774 |
| 1203721 | 10/1965 | Fed. Rep. of Germany | 72/250 |
| 2317633 | 3/1975 | Fed. Rep. of Germany | 72/426 |
| 2520163 | 11/1975 | Fed. Rep. of Germany | 72/250 |

*Primary Examiner*—Lowell A. Larson
*Attorney, Agent, or Firm*—Buell, Ziesenheim, Beck & Alstadt

[57] ABSTRACT

An apparatus for conveying tubular or bar-shaped rolled stock is provided having a collecting device which collects pieces of tube or bars from a cooling bed in closely spaced pockets, a transverse conveying device having the same pocket spacing as the collecting device which picks the collected pieces from the collecting device and transports them to and deposits them on a longitudinal conveyor, by means of which the pieces of rolled stock are fed to a cutting device which has a clamping device also provided with the same pocket spacing as the collecting device and which cuts the stock into portions of predetermined length.

8 Claims, 14 Drawing Figures

1
2
3
4
5
6'
8
9
10
11
X
Y

APPARATUS FOR CONVEYING TUBULAR OR BAR-SHAPED ROLLED STOCK

This application is a continuation of my copending application Ser. No. 359,698, filed Mar. 19, 1982, now abandoned, which in turn was a continuation of application Ser. No. 269,712, filed June 2, 1981, which in turn was a continuation of Ser. No. 058,169, filed July 17, 1979.

This invention relates to apparatus for conveying tubular bar-shaped rolled stock and particularly to an apparatus for conveying elongate rolled stock such as tubular or bar-shaped rolled stock, from the delivery station of a cooling bed, a straightening pallette or the like to a severing device which simultaneously subdivides a plurality of pieces of rolled stock into individual longitudinal portions.

The individual, largely cooled pieces of rolled stock arrive at the end of a cooling bed in, for example, a plant for producing round steel, at short intervals of time of only a few seconds. However, the pieces of rolled stock are still of considerable length and have to be subdivided into commercial lengths by several cuts. With a length of, for example, 60 meters, and a commercial length of, for example, 4 meters, 15 cuts have to be performed including the end cropping. It is impossible to perform these 15 cuts by means of only one severing device in the period of only a few seconds from the discharging of a piece of rolled stock from the cooling bed until the following piece of rolled stock is discharged, and the arrangement of a large number of simultaneously cutting severing devices is prohibited by reasons of economy. In the aforementioned example, 15 shears or saws would have to be provided.

In order, nevertheless, to be able to cut the rolled stock to the required commercial lengths without prolonging the periods of time between the discharging of the rolled commodity, and thus considerably reducing the output of the entire plant, the individual pieces of rolled commodity are collected beyond the discharge station of the cooling bed for a period of time which the severing device and its feed and discharge devices require to perform the necessary cuts. The number of pieces of rolled commodity collected during this period of time are then together fed to the severing device and together subdivided, whilst the following pieces of rolled commodity are being collected.

The apparatus with which the invention is concerned serves to collect the rolled stock beyond the discharge station and to convey the collected rolled commodity to the severing device.

In a known apparatus for this purpose, the individual pieces of rolled stock are conveyed transversely of their longitudinal direction to a conveyor belt or a roller bed by means of a so-called shuffle bar (which is very similar in appearance to a rake-type cooling bed in which all the rakes are driven by means of eccentric drives), the pieces of rolled stock being arrested directly upstream of the conveyor belt or roller bed by means of a stop until a sufficient number of pieces of rolled stock have collected at this location and until the severing device disposed therebeyond is clear. By means of levers, or by raising and lowering the end portion of the shuffle bar facing the conveyor belt or roller bed, the collected pieces of rolled stock are then together fed to the conveyer belt or roller bed which then feeds the pieces of rolled stock in their longitudinal direction to the severing device.

This known construction has the substantial disadvantage that it is impossible to collect the pieces of rolled commodity in an orderly manner upstream of the longitudinal conveying means. By way of example, if a curved or bent piece of rolled commodity is located in the region of the collecting station, it takes up the space which could be occupied by several pieces of rolled stock, whereby the predetermined number of pieces is not obtainable. Furthermore, a single piece of rolled commodity lying in an oblique position usually causes all the following pieces of rolled stock to assume an oblique position, so that the pieces of rolled stock are not collected in an orderly manner. Furthermore, even in the case of straight pieces of rolled stock, particularly when they have small cross-sectional dimensions, it frequently occurs that several pieces twist together during transverse conveyance and collecting, so that they have to be separated manually and sorted. Furthermore, in the known construction, it is in no way ensured that the individual pieces of rolled stock will not twist together or roll above and below one another and be displaced relative to one another in a longitudinal direction during transfer from the collecting device to the longitudinal conveyor. Thus, in the known construction, the individual pieces of rolled stock arrive at the severing device partially twisted together and partially in an oblique position with irregular spaces therebetween and displaced relative to one another in a longitudinal direction. Manual intervention is again required in order to be able to clamp and cut them in a satisfactory manner at the severing device. Furthermore, these considerable movements of the pieces of rolled stock relative to one another also cause a considerable amount of damage to their surfaces, thus considerably impairing the quality of the rolled stock.

In the known construction, it is also impossible to separate pieces of rolled commodity of differing quality in the well-defined manner required, without temporary stoppage of the rolling mill or allowing it to run idle in order artificially to produce the interval of time required. This disadvantage is very troublesome particularly when processing materials of high quality, since usually only a few pieces of rolled stock of the same material are rolled successively, followed by pieces of rolled stock of different quality. Since the differing qualities of material usually cannot be distinguished with the naked eye, it is a difficult and time-consuming matter subsequently to pick out pieces of rolled stock of specific quality.

In order at least to create somewhat better conditions, roller beds having profiled rollers have already been used as longitudinal conveying means in order to prevent the pieces of rolled stock from entering the severing device in an oblique position and to ensure that the individual pieces of rolled stock are fed to the severing device with the required lateral spacing. However, this is not successful in all cases, since, when transferring the pieces of rolled stock to the roller bed from the side, the pieces of rolled stock are frequently twisted together such that even the roller bed constructed in this manner cannot ensure that the pieces of rolled stock enter the severing device in an orderly manner. It is even less capable of doing this when, as is usually the case, the individual pieces of rolled stock are displaced relative to one another in a longitudinal direction upon transfer to the roller bed. The rolled stock then first has to be moved up to a stop or abutment in order to render it possible to sub-divide the rolled stock into commercial lengths in an economical manner. Furthermore, when using a stop or abutment, there is the risk of bending and it is not even ensured that all the end faces remain lying directly in front of the stop or abutment.

An object of the invention is to provide an apparatus of the kind mentioned initially which does not have the disadvantages mentioned above and which causes the pieces of rolled stock to enter the severing device and the clamping devices thereof in a satisfactory manner and largely renders manual intervention unnecessary.

The present invention resides in apparatus for conveying pieces of elongate rolled stock from the delivery end of a cooling bed, a straightening pallette or the like to a severing device which has clamping pockets for the pieces of rolled stock and simultaneously sub-divides a plurality of pieces of rolled stock into individual longitudinal portions, said apparatus comprising a collecting device disposed beyond the discharge station for collecting a plurality of pieces of rolled stock, the collecting device having a separate reception pocket extending transversely of the conveying direction for each of the discharged pieces of rolled stock to be collected together and being movable rectilinearly, during collection, in a stepwise manner by one reception pocket pitch spacing at a time transversely of the longitudinal direction of the pieces of rolled stock lying in their reception pockets to carry the pieces of rolled stock along, and longitudinal conveying means disposed beyond the collecting device for conveying the rolled stock in the latter's longitudinal direction, the longitudinal conveying means and the clamping means of the severing device having the same number of reception pockets, with the same pocket spacing, as the collecting device, and the pieces of rolled stock being placeable into the reception pockets of the longitudinal conveying means without movement relative to one another.

Thus, in the first instance, the pieces of rolled stock to be collected together can be collected in an orderly manner by virtue of the fact that each of these pieces is placed into a separate reception pocket of the collecting device and thus each piece of rolled stock is kept separate from the other pieces of rolled stock. The reception pockets can then be located very close together in order to be able to collect a maximum number of pieces of rolled stock in a miniumum of space. The reception pockets are then dimensioned such that even slightly curved pieces of rolled stock have sufficient space therein without coming into contact with the adjacent pieces of rolled stock. Consequently, a predetermined number of pieces of rolled stock can be collected during each working cycle by means of the apparatus in accordance with the invention, and, in an advantageous manner, the pieces are prevented from assuming an oblique or skew position or from twisting together. This is also ensured during subsequent transverse conveyance to the longitudinal conveying means, since the pieces of rolled stock lie undisturbed in their reception pockets and are not conveyed from one pocket into another or along roll-off track. Since the longitudinal conveying means disposed therebeyond, and the clamping means of the severing device, have the same number of reception pockets, with the same pocket spacing, as the collecting device, the pieces of rolled stock need not move relative to one another, not even when they are transferred from the collecting device to the longitudinal conveying means or when they enter the clamping means of the severing device. The pieces of rolled stock also do not move relative to one another in a longitudinal direction. Consequently, in the apparatus in accordance with the invention, and in contrast to the known constructions, the end faces of the pieces of rolled stock tend to remain, during the entire conveying operation, in the same alignment in which they were deposited at the end of the cooling bed. Thus, it is possible to dispense with stops in advance of and beyond the severing device and it is necessary to ensure at only one location, such as in the region of the end of the cooling bed, that the leading or trailing end portions of the pieces of rolled stock are aligned rectilinearly relative to one another in order to ensure that the work-material also enters, in the same position, the severing device disposed upstream and thus can be subdivided in an economical manner. Difficulties during clamping of the work-material in the severing device and upon introducing the work-material into the clamping device are avoided since, in the apparatus in accordance with the invention, the work-material always maintains an accurately defined attitude, and never changes it, from the discharge station of the cooling bed until it enters the clamping means of the severing device.

A further advantage of the apparatus in accordance with the invention resides in the fact that the surfaces of the work-material are less likely to be damaged during transverse and longiudinal conveyance, since each piece of rolled stock always lies in a separate reception pocket and is not rolled, pushed or thrown. Furthermore, in the apparatus in accordance with the invention, it is possible, without shutting down the rolling mill, to separate pieces of rolled stock of differing quality from the others in a well-defined manner and to keep them separated, for the purpose of identification, by, for example, advancing the collecting device once by two reception pocket spacings and thus leaving one reception pocket free, this being maintained up to the region of the separating device where it also clearly indicates the change of quality.

In a preferred embodiment of the invention, the longitudinal conveying means comprises a large number of individual bearers which are provided with the reception pockets and are longitudinally displaceably guided on a support track and circulate in a conveyor-belt-like manner and are driven by traction means in the region of the support track. In this manner, it is ensured that the pieces of rolled stock also do not move relative to one another on the longitudinal conveying means, neither in the longitudinal direction of the rolled stock nor transversely thereof in a manner which cannot be excluded in the known roller beds.

It is particularly advantageous if a transverse conveying device is provided between the collecting device and the longitudinal conveying means and has the same number of reception pockets, with the same spacing of the pockets, as the collecting device. By means of such transverse conveying device, the pieces of rolled stock are removable from the collecting device, without movement relative to one another, no later than the instant the collecting device is filled and are transversely conveyable and placeable onto the longitudinal conveying means.

In one embodiment, in which only one collecting device and one longitudinal conveying means are provided, there would be a pause whenever the collecting device is full and during which a piece of rolled commodity could not be received by the cooling bed, the straightening pallette or the like until the collected work-material is deposited onto the longitudinal conveying means by moving the collecting device from the discharge end to the longitudinal conveying means and the collecting device is again located in its reception position at the discharge station. Advantageously, this interruption does no occur in the aforementioned embodiment of the invention, since the collecting device is immediately emptied by the transverse conveying device as soon as the required number of pieces of rolled stock has been collected. Thus, the collecting device itself does not have to convey the work-material transversely to the longitudinal conveying means and to deposit the work-material onto the longitudinal conveying means, and can immediately return to its first reception position as soon as the transverse conveying device has received the work-material. Since the transverse conveying device can take the work-material from the collecting device very rapidly, and the transverse conveying device is then also able to take the last piece of rolled stock directly from the cooling bed, or from the straightening pallette or the like, the short period of time available up to the discharge of the following piece of rolled stock is sufficient to empty the collecting device and to return it to its first reception position. During the entire following collecting operation, the transverse conveying device then has sufficient time to convey the work-material to the longitudinal conveying means and to deposit it thereon and to return to a predetermined waiting position in the vicinity of the collecting device. Since the transverse conveying device also has the same number of reception pockets, with the same spacing between the pockets, as the collecting device and the longitudinal conveying means, there are no movements of the pieces of rolled stock relative to one another even upon reception of the work-material by the collecting device and upon trasferring the work-material to the longitudinal conveying means by the transverse conveying device.

It has proved to be advantageous for the transverse conveying device to be raisable and lowerable and movable transversely of the longitudinal direction of the tubes and movable in a comb-like manner into a position between the support members of the collecting device and the support arms or bearers of the longitudinal conveying means until the corresponding reception pockets are in a coaxial position. Thus, the transverse conveying device can move into the region of the collecting device where it can be raised, the work-material being received by the transverse conveying device. The transverse conveying device can then be subsequently moved transversely up to the longitudinal conveying means where the transverse conveying device enters between the support arms where it is lowered. When the lowering operation is effected in the correct position, the pieces of rolled stock are placed into the separate reception pockets of the longitudinal conveying means without movement of the pieces of rolled stock relative to one another.

The invention is further described, by way of example, with reference to the drawings, in which.

Figures 1, 2, 3:
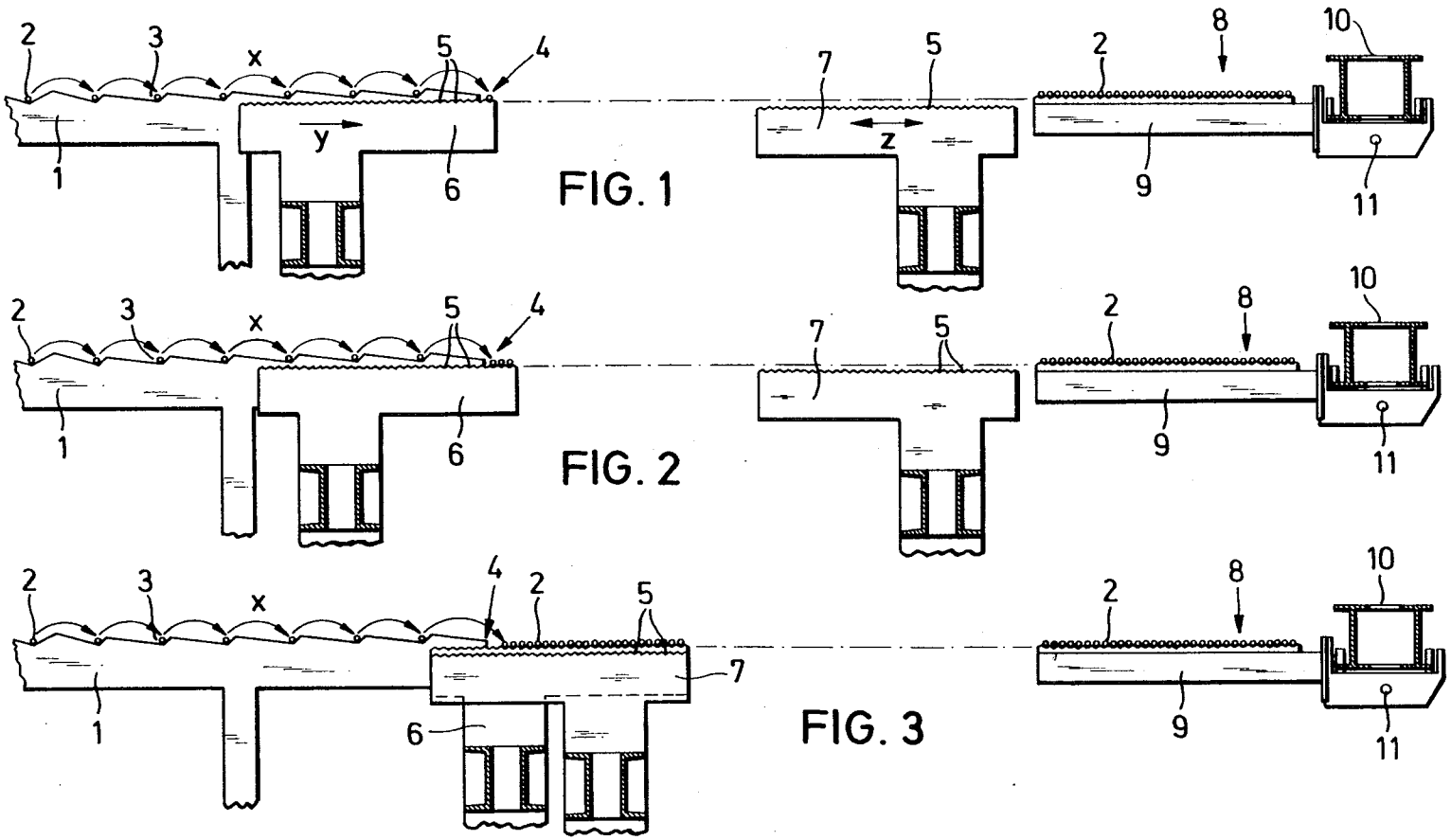
FIGS. 1 to 9 are diagrammatic side elevations of conveying apparatus according to the invention, showing a complete movement cycle.

FIGS. 1 to 9 show the end portion 1 of a rake-type cooling bed in which pieces 2 of rolled stock, such as pieces of tubing or bar material, are conveyed transversely from one cooling bed pocket 3 to the next in the direction of the arrows x and are at the same time cooled and straightened. In the region of the discharge station 4 at the end of the cooling bed 1, the pieces 2 of rolled stock are placed successively into parallel and closely mutually adjacent reception pockets 5 of a collecting device 6 which is moved in the direction of the arrow y in a stepwise manner by exactly one reception pocket spacing after each piece 2 of rolled stock has been placed into a reception pocket. This situation is illustrated in FIGS. 1 and 2.

The cooling bed 1 and the collecting device 6 have a large number of "rakes" or support members which are spaced side-by-side and which extend parallel to one another and interengage in a comb-like manner in the region of the end of the cooling bed, so that the pieces 2 of rolled stock are held at relatively short distances apart over their entire, considerable length.

Furthermore, FIGS. 1 to 9 show a transverse conveying device 7 which is movable in the direction of the arrow z and transversely of the rolled stock and which is also raisable and lowerable. The transverse conveying device 7 has the same number of reception pockets 5 as the collecting device 6. Referring to FIGS. 1 and 2, the transverse conveying device 7 is located in its lowered waiting position.

Furthermore, FIGS. 1 to 9 show a longitudinal conveying means 8 having a large number of individual cantilever bearers 9 provided with reception pockets 5 (see FIG. 7) in which are located pieces 2 of rolled stock. The longitudinal conveying means 8 also has the same number of reception pockets 5 as the collecting device 6. The bearers 9 (of which only one is shown in the drawings) are displaceably guided at only one end for movement in the longitudinal direction of the rolled stock on a support track 10 where they are driven by traction means 11. The longitudinal conveying means 8 are driven intermittently and circulate in the manner of a conveyor belt. When the bearers 9 are stationary, the support members of the transverse conveying device 7 can enter the region of the longitudinal conveying means 8 in a comb-like manner, as is also possible in the case of the rake-type cooling bed 1, and in the case of the collecting device 6. The longitudinal conveying means 8 feeds the rolled stock to a severing device (not shown), where the stock is intermittently clamped in a clmaping device (not shown) having the same number of reception pockets and the same pocket spacing as the collecting device 6 and is cut into portions of predetermined length.

Figure 4:
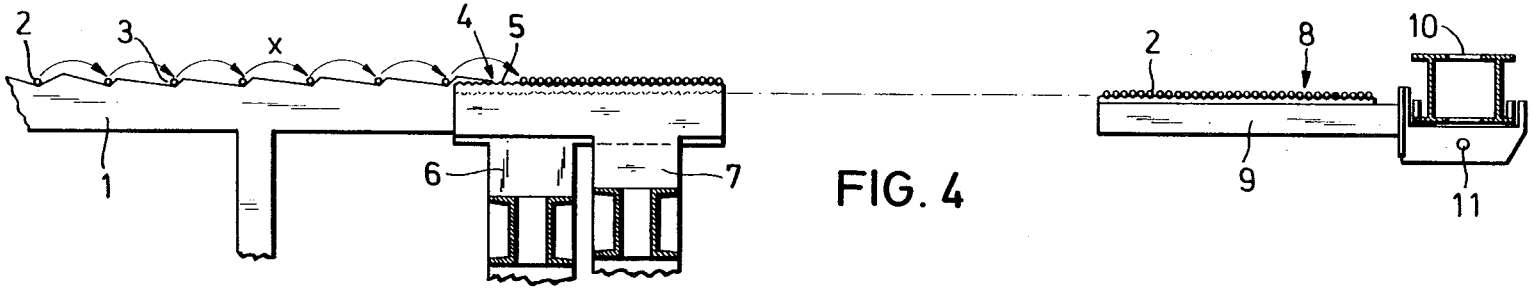
Figure 5:
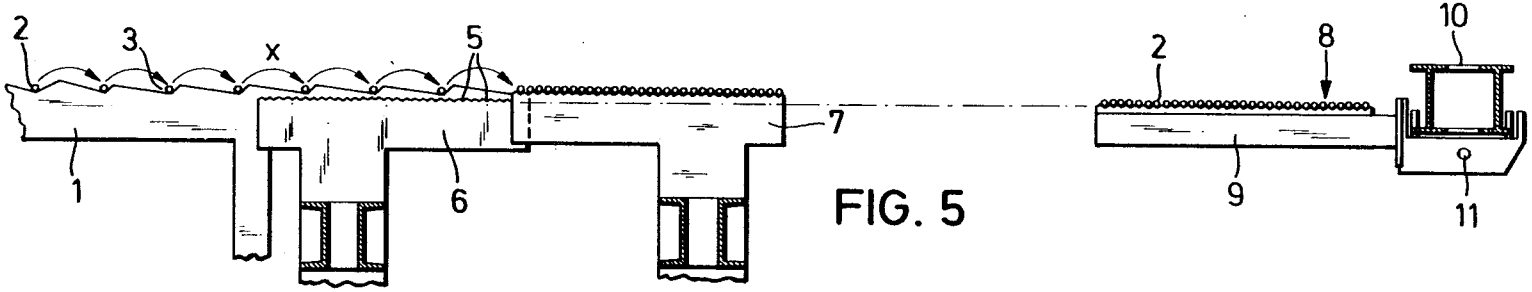
Figure 6:
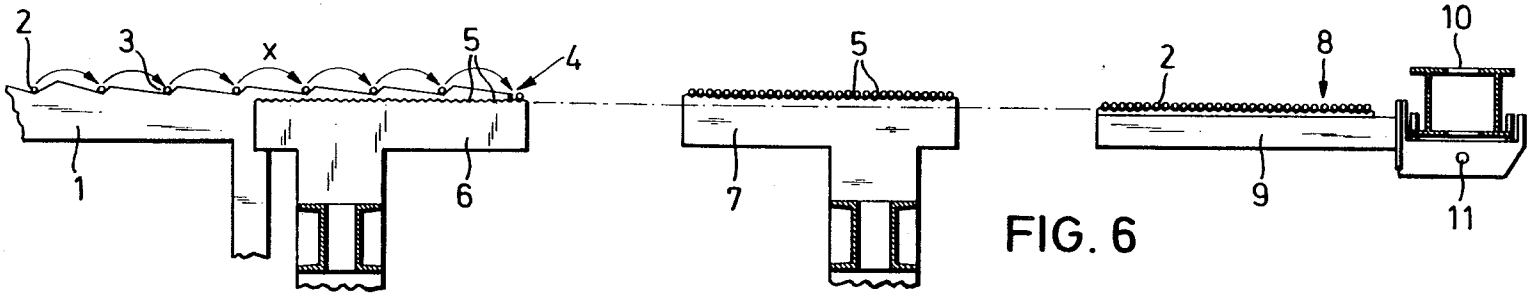

FIG. 3 shows that situation in which the greater part of the collecting device 6 is occupied by work-material 2 and in which the transverse conveying device 7 is lowered but is otherwise in a congruent position only slightly below the collecting device 6. As is shown in FIG. 4, the transverse conveying device 7 is raised shortly before the collecting device 6 is fully loaded with work-material 2, so that the transverse conveying device 6 takes over the collected pieces 2 of rolled stock from the collecting device 6, and the unoccupied reception pockets 5 of the transverse coneying device 7 are loaded with the following pieces 2 of rolled stock directly from the cooling bed 1. In FIG. 5, the transverse conveying device 7 is fully loaded with work-material 2, and the collecting device 6 has in the meantime returned to its starting position corresponding to FIG. 1 and is ready to receive the following pieces 2 of rolled stock.

Figures 7, 8, 9:
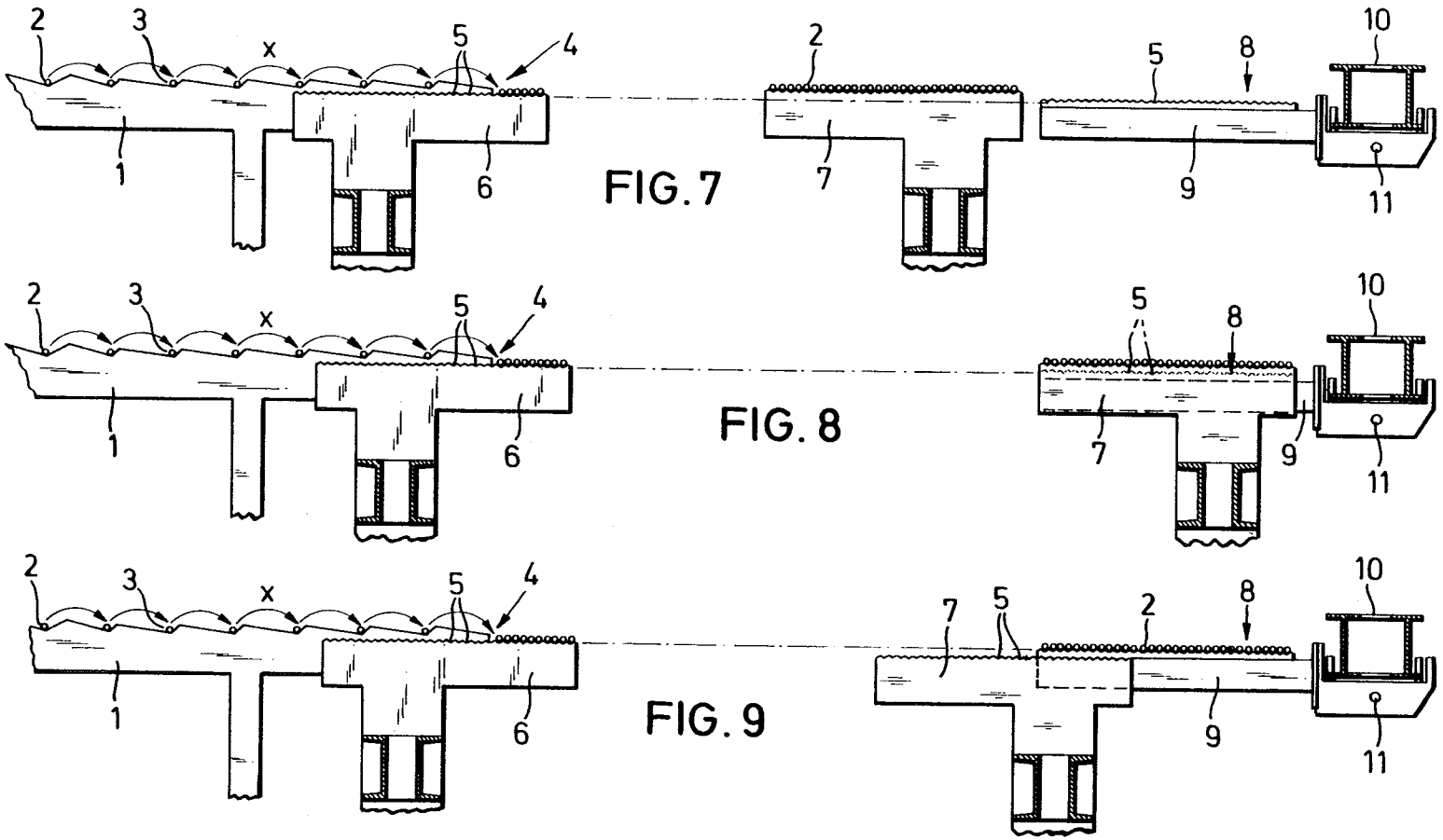

FIGS. 6 to 9 show how the collecting device 6 is refilled and how the transverse conveying device 7 moves towards the longitudinal conveying means 8 whose bearers 9 only become free of the work-material 2 when the transverse conveying device 7 is already in the vicinity, as is shown in FIG. 7. If need be, the transverse conveying device 7 must always wait in its raised position until the reception pockets 5 of the bearers 9 have become free. It is only then, with the longitudinal conveying means 8 stationary, that the transverse conveying device 7 can be moved as shown in FIG. 8 into the region between the bearers 9 where it is lowered. After the transverse conveying device 7 has been lowered, and the work-material 2 has been received by the bearers 9 of the longitudinal conveying means 8, the transverse conveying device 7 is returned in a lowered position to the waiting position shown in FIG. 1 where it remains until the collecting device 6 has been almost filled as shown in FIG. 3, so that the transverse conveying device 7 again has to be moved towards the cooling bed 1 or towards the collecting device 6, and the working cycle recommences.

Figure 10:
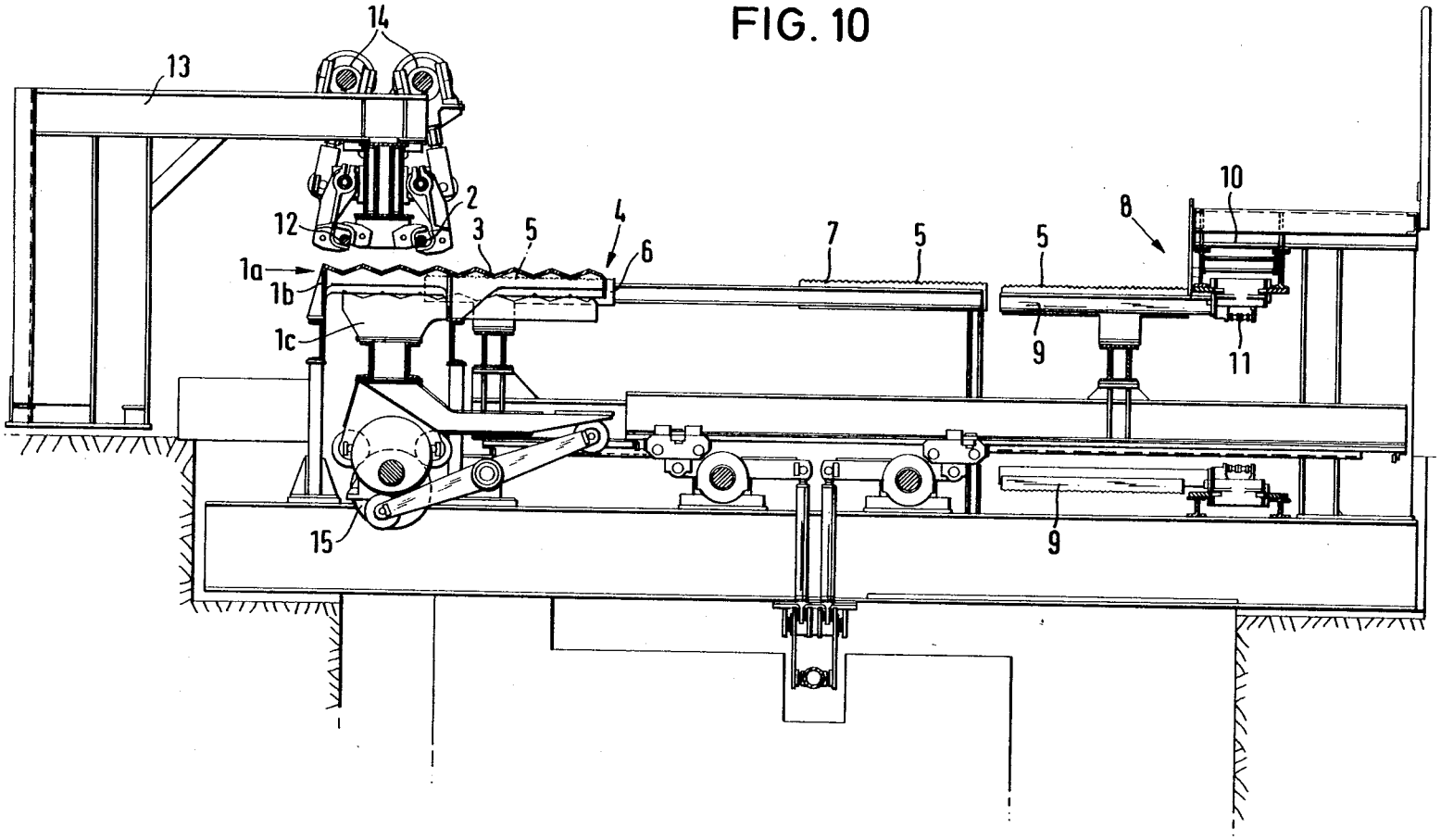
FIG. 10 is a more precise, cross-sectional illustration of an apparatus in accordance with the invention.
Figures 11, 12, 13, 14:
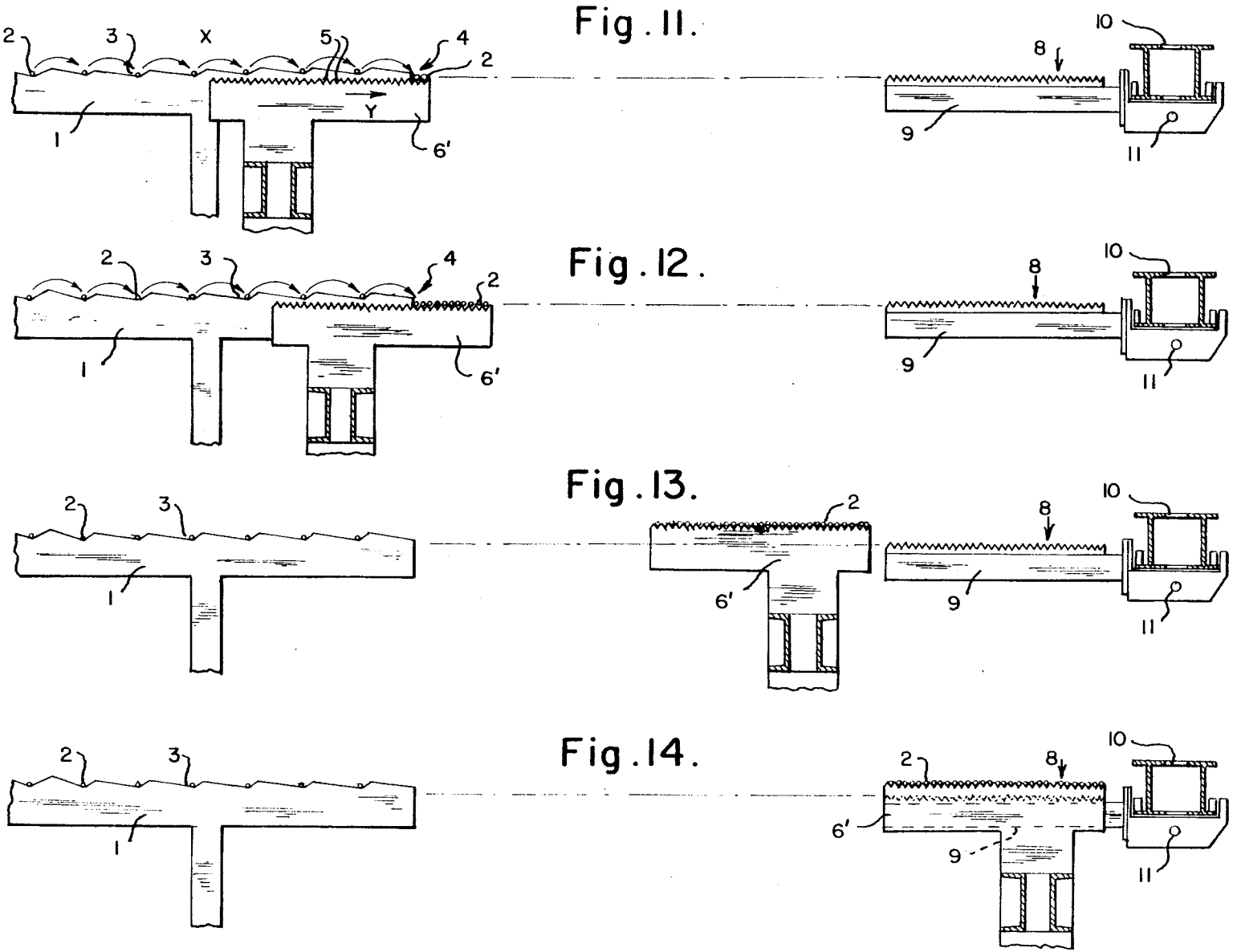
FIGS. 11 to 14 are diagramatic side elevations of collecting conveying apparatus according to the invention, showing a complete movement cycle.

In the embodiment of FIG. 10, the work material 2 is fed by way of two brake channels 12 which are suspended from a carrier system 13. The brake channels 12 can be opened by means of eccentric drives 14, so that the work-material 2 drops into pockets 3 of a straightening pallette 1*a*. The straightening pallette 1*a* has fixed rakes 1*b* and movable rakes 1*c*. The latter are driven by an eccentric drive 15. Consequently, the work material 2 is moved from reception pocket 3 to reception pocket 3 of the straightening pallette 1*a* and away from the brake channels 12 and, in the same manner as described with reference to FIGS. 1 to 9, is fed to a collecting device 6. Further conveyance is effected in the same manner as specified above, and the reference numerals chosen in the above are also used in FIG. 10 and designate the same parts of the apparatus.

In FIGS. 11 to 14 we have illustrated an arrangement in which a combined collecting conveyor device 6' is provided which performs the functions of collector 6 and conveyor 7 of FIGS. 1 to 9.

In the foregoing specification we have set out certain preferred practices and embodiments of our invention; however, it will be understood that this invention may be otherwise embodied within the scope of the following claims.

We claim:

1. Apparatus for conveying pieces of elongate rolled stock from a discharge station at the delivery end of a cooling bed, a straightening pallette or the like to a severing device which has reception pockets for the pieces of rolled stock and which simultaneously subdivides a plurality of pieces of rolled stock into individual longitudinal portions, said apparatus comprising at least one generally horizontally and vertically reciprocable collecting conveying device operatively disposed at the discharge station for collecting a plurality of pieces of rolled stock, the at least one collecting conveying device having a rigid bed with a separate reception pocket extending transversely of the conveying direction for each of the discharged pieces of rolled stock to be collected together and being movable rectilinearly, during collection, in a stepwise manner by one reception pocket pitch spacing at a time transversely of the longitudinal direction of the pieces of rolled stock lying in their reception pockets to carry the pieces of rolled stock along, and longitudinal substantially continuous bed longitudinally pocketed conveying means spaced from the discharge station for conveying the rolled stock in the latter's longitudinal direction, the longitudinal conveying means having the same pocket spacing, as said at least one collecting conveying device, and as the severing device to which delivery is to be made and the pieces of rolled stock being placeable into the reception pockets of the longitudinal conveying means without movement relative to one another by said at least one collecting conveying device, said at least one collecting conveying device reciprocating in a horizontal plane to and from the discharge station and the longitudinal conveying means.

2. Apparatus as claimed in claim 1 in which the longitudinal conveying means comprises a large number of individual bearers which are provided with the reception pockets and which are together longitudinally displaceably guided on a support track and circulate in a conveyor-belt-like manner and are driven by traction means in the region of the support track.

3. Apparatus as claimed in claim 1 or 2 in which said at least one collecting conveying device comprises a transverse conveying means and a collecting device positioned between said transverse conveying means and said discharge station for collecting said plurality of pieces of rolled stock in said stepwise manner said transverse conveying means and collecting device having the same number of reception pockets, with the same spacing of the pockets and being provided between the discharge station and the longitudinal conveying means, said transverse conveying means being adapted to remove the pieces of rolled stock from the collecting device, without movement of the pieces of rolled stock relative to one another, no later than the instant the collecting device is filled, and to transversely convey the pieces of rolled stock and place them onto the longitudinal conveying means.

4. Apparatus as claimed in claim 3 in which the transverse conveying device is raisable and lowerable and is movable transversely of the longitudinal direction of the rolled stock and movable in a comb-like manner into a position between the support members of the collecting device and the bearers of the longitudinal conveying means until the corresponding reception pockets are in registry with one another.

5. Apparatus as claimed in claim 3 wherein the trasnverse conveying means is movable reciprocably between the collecting device and the longitudinal conveying means.

6. Apparatus as claimed in claim 3 wherein the transverse conveying means is movable reciprocably between the collecting device and the longitudinal conveying means and vertically up and down whereby it can move beneath pieces of rolled stock on the collecting device into alignment therewith and then vertically up to remove and transport said pieces to the longitudinal collecting means.

7. Apparatus as claimed in claim 3 wherein the pockets in the collecting device, the transverse conveying means and the longitudinal conveying means have a like saw tooth configuration.

8. Apparatus as claimed in claim 3 wherein the work material is fed by means of brake channels onto a straightening pallette and then to said collecting device.

* * * * *